US008009183B2

(12) United States Patent
Baba

(10) Patent No.: US 8,009,183 B2
(45) Date of Patent: Aug. 30, 2011

(54) THERMAL PRINTER AND METHOD OF CONTROLLING THE SAME

(75) Inventor: Sumio Baba, 7 River Valley Close (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 59 days.

(21) Appl. No.: 12/555,035

(22) Filed: Sep. 8, 2009

(65) Prior Publication Data

US 2010/0060707 A1 Mar. 11, 2010

(30) Foreign Application Priority Data

Sep. 8, 2008 (JP) ..... 2008-230109

(51) Int. Cl.
*B41J 3/60* (2006.01)
*B41J 2/32* (2006.01)

(52) U.S. Cl. ..... 347/171

(58) Field of Classification Search ..... 347/171, 347/218; 400/120.01, 82, 188
See application file for complete search history.

(56) References Cited

U.S. PATENT DOCUMENTS 7,671,878 B2 * 3/2010 Yamada et al. ..... 347/171
7,782,349 B2 * 8/2010 Baba et al. ..... 347/171
2007/0273744 A1 * 11/2007 Yamada et al. ..... 347/204
2007/0279476 A1 * 12/2007 Baba et al. ..... 347/190
2009/0015647 A1 * 1/2009 Rawlings et al. ..... 347/213
2009/0015649 A1 * 1/2009 Keeton et al. ..... 347/217
2009/0017236 A1 * 1/2009 Keeton et al. ..... 428/32.68
2009/0017237 A1 * 1/2009 Rawlings et al. ..... 428/32.84

FOREIGN PATENT DOCUMENTS

| | | | |
|---|---|---|---|
| EP | 947340 | * | 10/1999 |
| EP | 1862317 | * | 12/2007 |
| EP | 1862320 | * | 12/2007 |
| JP | 2001-071569 | | 3/2001 |
| JP | 2005221821 | | 8/2005 |
| JP | 2008-006802 | * | 1/2008 |
| JP | 2009-018593 | * | 1/2009 |

OTHER PUBLICATIONS

Machine-generated translation of JP 2001-071569, published on Mar. 2001.*

* cited by examiner

*Primary Examiner* — Huan H Tran
(74) *Attorney, Agent, or Firm* — Turocy & Watson, LLP

(57) ABSTRACT

Two or more kinds of thermal paper are set in a paper housing unit, whether the thermal paper are double-side thermal paper or one-side thermal paper is previously determined by printing marks and detecting the printed marks, and the thermal paper are selectively fed for double-side printing and one-side printing.

13 Claims, 6 Drawing Sheets

THERMAL PRINTER AND METHOD OF CONTROLLING THE SAME

CROSS-REFERENCE TO RELATED APPLICATION

This application is based upon and claims the benefit of priority from prior Japanese Patent Application No. 2008-230109, filed Sep. 8, 2008, the entire contents of which are incorporated herein by reference.

TECHNICAL FIELD

The present invention relates to a thermal printer using double-side thermal paper, and a method of controlling the thermal printer.

BACKGROUND

There is a conventional thermal printer, which is provided with a thermal head at positions corresponding to one side and the other side of thermal paper having a thermosensitive layer on both sides, so-called double-side thermal paper, and prints both sides of thermal paper by operating both thermal heads, or prints one side of thermal paper by operating one of the thermal heads (e.g., Jpn. PAT. Appln. KOKAI Publication No. 2001-71569).

Double-side thermal paper is more expensive than thermal paper with a thermosensitive layer on only one side, so-called one-side thermal paper. Therefore, one-side printing using double-side thermal paper is undesirable from an economic viewpoint.

SUMMARY

It is an object of the present invention to provide a thermal printer, which is configured to set two or more kinds of thermal paper, and selects double-side thermal paper for double-side printing and one-side thermal paper for one-side printing, thereby effectively and economically using thermal paper, and a method of controlling the thermal printer.

A thermal printer according to an aspect this invention comprising: a paper housing unit which sets two or more kinds of thermal paper; a paper feeding unit which selectively feeds the thermal paper set in the paper housing unit; a first thermal head which prints one side of thermal paper fed by the paper feeding unit; a second thermal head which prints the other side of thermal paper fed by the paper feeding unit; a first control section which feeds thermal paper from the paper feeding unit, and prints a mark on both sides of the thermal paper with the first and second thermal heads; mark sensors which detects the marks printed by the first control means; a determination section which determines whether the thermal paper fed from the paper feeding unit is double-side thermal paper having a thermosensitive layer on both sides, or one-side thermal paper having a thermosensitive layer on only one side, according to the detection results of the mark sensors; a second control section which selects double-side thermal paper set in the paper housing unit based on the determination result of the determination section, and feeds the paper by the paper feeding unit, at the time of double-side printing; and a third control section which selects one-side thermal paper set in the paper housing unit based on the determination result of the determination section, and feeds the paper by the paper feeding unit, at the time of one-side printing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Figure 1:
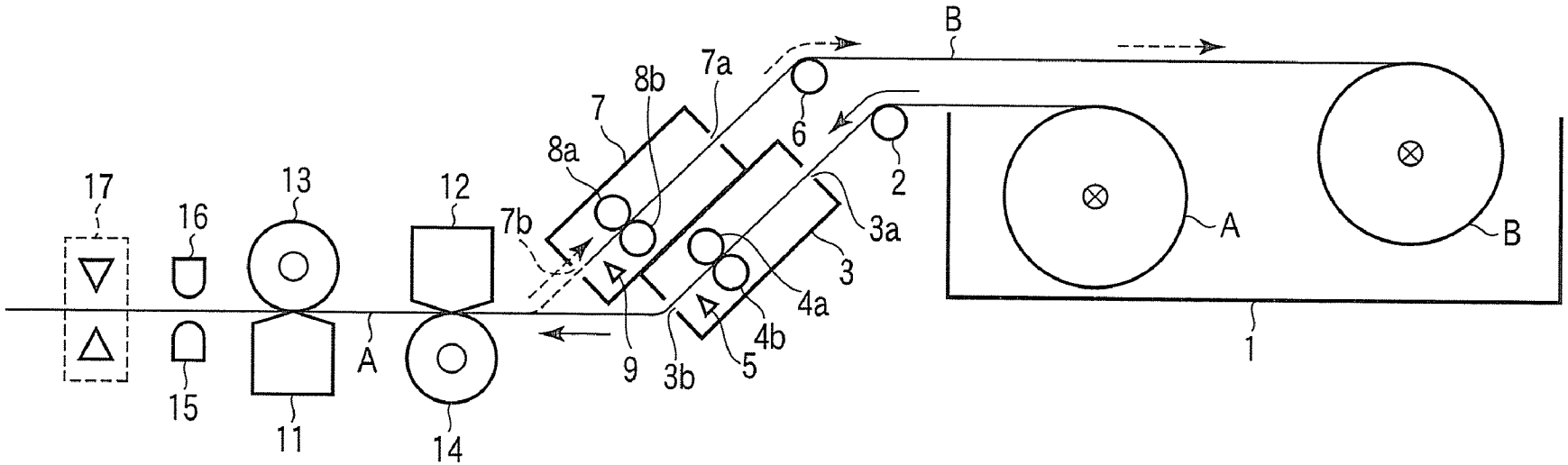
FIG. 1 is a diagram showing a configuration of an essential part of an embodiment of the invention, in a state in which thermal paper is fed from one of feeders.

An embodiment of the invention will be explained hereinafter with reference to the accompanying drawings. First, a configuration of an essential part is shown in FIG. 1.

A paper housing unit 1 contains two or more kinds of thermal paper roll A and B. The thermal paper A and B are available in so-called double-side thermal paper having a thermosensitive layer on one side (a front side) and the other side (a back side), and so-called one-side thermal paper having a thermosensitive layer on only one side (a front side). The thermosensitive layers are made of material, which turns black or red, for example, when it is heated to a temperature higher than a predetermined value.

The user sets thermal paper A and B in the paper housing unit 1, and pulls out the front end of the thermal paper A, runs it over a roller 2, and inserts it into an inlet slit 3*a* of a feeder 3. The front end of the inserted thermal paper A is held and fed by paper-feeding rollers 4*a* and 4*b*, and detected by a paper sensor 5 which detects existence of paper, and set ready for printing at a position corresponding to the paper sensor 5. Then, the user pulls out the front end of the thermal paper B set in the paper housing unit 1, runs it over a roller 6, and inserts it into an inlet slit 7*a* of a feeder 7. The front end of the inserted thermal paper B is held and fed by paper-feeding rollers 8*a* and 8*b*, and detected by a paper sensor 9 which detects existence of paper, and set ready for printing at a position corresponding to the paper sensor 9.

The feeders 3 and 7 has outlet slits 3*b* and 7*b*, respectively. A paper-conveying path is provided forward of the outlet slits 3*b* and 7*b*. The thermal paper is fed out from one of the outlet slits 3*b* and 7*b* to the paper-conveying path. Along the paper-feeding path, there are provided a first thermal head 11 which contacts the front sides (one sides) Aa and Ba of the thermal paper A and B, and a second thermal head 12 which contacts the back sides (the other sides) Ab and Bb of the thermal paper A and B. The first and second thermal heads 11 and 12 are shaped to extend in the direction perpendicular to the thermal paper A/B feeding direction, or in the width direction of the thermal paper A/B, and provided at positions apart each other along the thermal paper A/B feeding direction. The first thermal head 11 is positioned in the downstream of the second thermal head 12 in the thermal paper A/B feeding direction.

A first platen roller 13 is provided at a position opposite to the first thermal head 11 through the paper-feeding path, to press the thermal paper A/B to the first thermal head 11. A second platen roller 14 is provided at a position opposite to the second thermal head 12 through the paper-feeding path, to press the thermal paper A/B to the second thermal head 12. Further, in the downstream of the first thermal head 11 in the paper-feeding path, first and second mark sensors 15 and 16 are oppositely provided. The first mark sensor 15 is a reflection type optical sensor, which emits light to the front sides Aa and Ba of the thermal paper A and B, and takes in the reflected light from the front sides Aa and Ba, and detects a front-side mark Ma described later to be printed on the front sides Aa and Ba of the thermal paper A and B. The second mark sensor 16 is a reflection type optical sensor, which emits light to the back sides of the thermal paper Ab and Bb, takes in the reflected light from the back sides Ab and Bb, and detects a backside mark Mb to be printed on the back sides Ab and Bb of the thermal paper A and B. A cutter 17 for cutting the thermal paper A and B is provided in the downstream of the first and second mark sensors 15 and 16 in the paper-feeding path.

Figure 2:
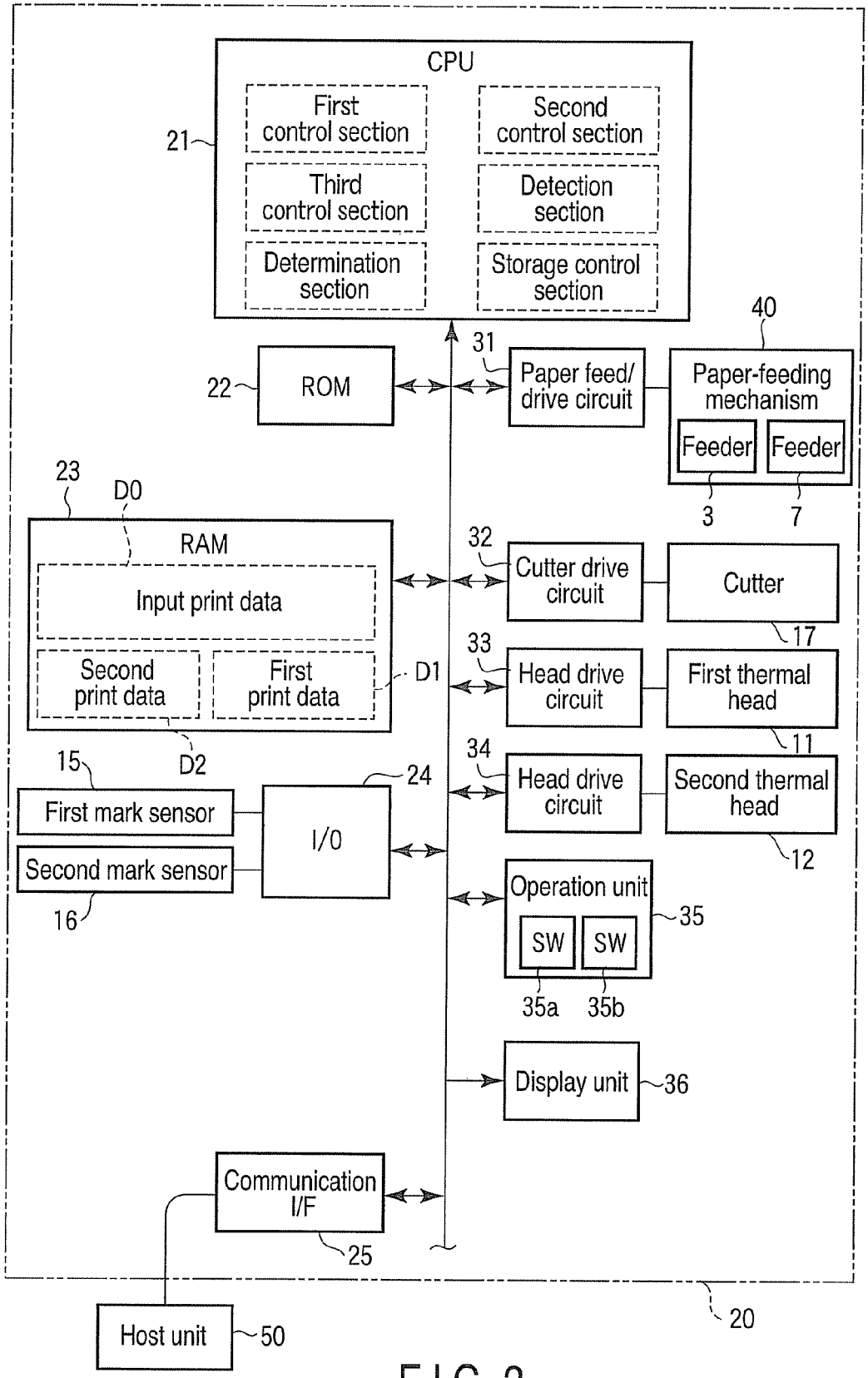
FIG. 2 is a block diagram of a control circuit of an embodiment of the invention.

FIG. 2 shows a control circuit of a thermal printer 20, which includes the configuration of FIG. 1. A main control unit CPU 21 is connected to a ROM 22 for storing a control program, a RAM 23 for storing data, an input/output unit (I/O) 24, a communication interface 25, a paper feed/drive circuit 31, a cutter drive circuit 32, head drive circuits 33 and 34, an operation unit 35 for setting operating conditions, and a display unit 36. The input/output unit 24 is connected to the first mark sensor 15 and second mark sensor 16. The communication interface 25 is connected to an external host unit 50. The paper feed/drive circuit 31 drives a paper-feeding mechanism (a paper-feeding means) 40. The paper-feeding mechanism 40 includes feeders 3 and 7, and a motor, and selectively feeds one of the thermal paper A and B by the feeders 3 and 7. The cutter drive circuit 32 drives the cutter 17. The head drive circuits 33 and 34 drive the first and second thermal heads 11 and 12, respectively. The operation unit 35 has a first feed switch 35*a* for the thermal paper A, and a second feed switch 35*b* for the thermal paper B.

The CPU 21 has the following means (1) to (6) as primary functions.

(1) A first control section, which feeds the thermal paper A from the feeder 3, and prints marks Ma and Mb on the respective sides of the thermal paper A with the first and second thermal heads 11 and 12. Specifically, the first control section feeds the thermal paper A from the feeder 3, and prints the front-side mark Ma and backside mark Mb on the front side Aa and back side Ab of the thermal paper A with the first and second thermal heads 11 and 12, when the front end of the thermal paper A is inserted into the feeder 3, and the feed switch 35*a* of the operation unit 35 is turned on. The first control section feeds the thermal paper B from the feeder 7, and prints the front-side mark Ma and backside mark Mb on the front side Ba and back side Bb of the thermal paper B with the first and second thermal heads 11 and 12, when the front end of the thermal paper B is inserted into the feeder 7, and the feed switch 35*b* of the operation unit 35 is turned on.

(2) A detection section, which detects the marks Ma and Mb with the first and second mark sensors 15 and 16 respectively, when the marks Ma and Mb are printed.

(3) A determination section, which determines whether the thermal paper A fed from the feeder 3 is double-side thermal paper or one-side thermal paper, and whether the thermal paper B fed from the feeder 7 is double-side thermal paper or one-side thermal paper, according to the detection results of the detection section. Specifically, the determination section determines the thermal paper A fed from the feeder 3 to be double-side thermal paper, when the first and second sensors 15 and 16 detect the marks Ma and Mb, and determines the thermal paper A to be one-side thermal paper, when the first mark sensor 15 detects the front-side mark Ma. The determination section determines the thermal paper B fed from the feeder 7 to be double-side thermal paper, when the first and second sensors 15 and 16 detect the marks Ma and Mb, and determines the thermal paper B to be one-side thermal paper, when the first mark sensor 15 detects the front-side mark Ma.

(4) A storage control section, which stores the determination results of the determination section in the RAM 23 by associating with each thermal paper set in the paper housing unit 1. Hereinafter, for an explanation convenience, it is assumed that the thermal paper A is determined to be double-side thermal paper and stored as double-side thermal paper, and the thermal paper B is determined to be one-side thermal paper and stored as one-side thermal paper.

(5) A second control section, which selects and feeds the thermal paper (double-side thermal paper) A in the paper housing unit 1 by the feeder 3 based on the stored contents, at the time of double-side printing, and feeds the other thermal paper (one-side thermal paper) B by the other feeder 7, when the paper sensor 5 of the feeder 3 detects that the thermal paper A runs out.

(6) A third control section, which selects and feeds the thermal paper (one-side thermal paper) B in the paper housing unit 1 by the feeder 7 based on the stored contents, at the time of one-side printing, and feeds the other thermal paper (double-side thermal paper) A by the other feeder 3, when the paper sensor 9 of the feeder 7 detects the thermal paper B runs out.

Figure 3:
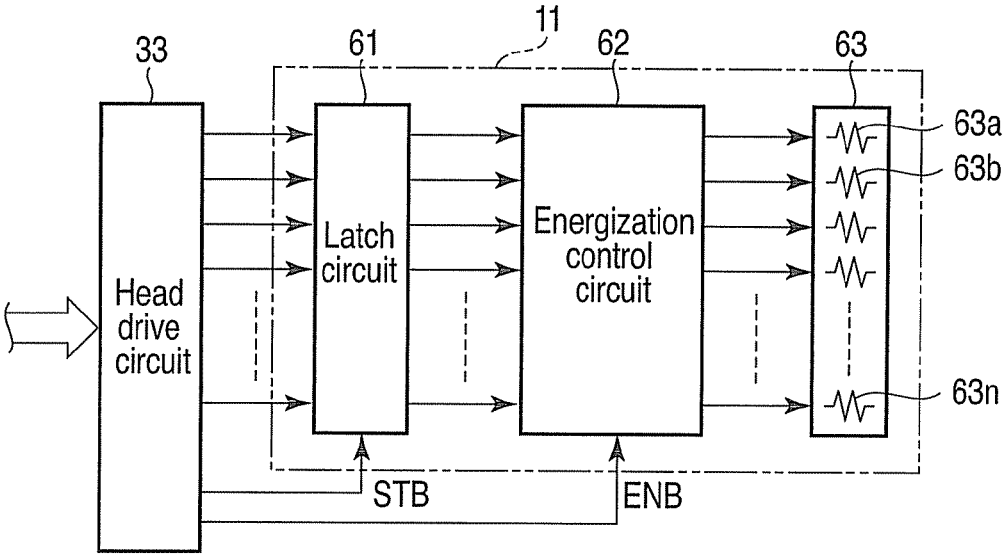
FIG. 3 is a block diagram showing a concrete configuration of a thermal head in an embodiment of the invention.

As shown in FIG. 3, the first thermal head 11 comprises a latch circuit 61, an energization control circuit 62, and an edge head 63. The edge head 63 has a number of linearly arranged heat transfer heating elements 63*a*, 63*b*, . . . 63*n*. The latch circuit 61 latches the first print data D1 supplied from the head drive circuit 33 for every line according to a strobe signal STB supplied from the head drive circuit 33. The energization control circuit 62 controls energization of the heating elements 63*a*, 63*b*, . . . 63*n* of the edge head 63, according to the data in the latch circuit 61, at the timing when the enable signal ENB supplied from the head drive circuit 33 is activated. The second thermal head 12 has the same configuration as the first thermal head 11. An explanation thereof is omitted.

Figure 4:
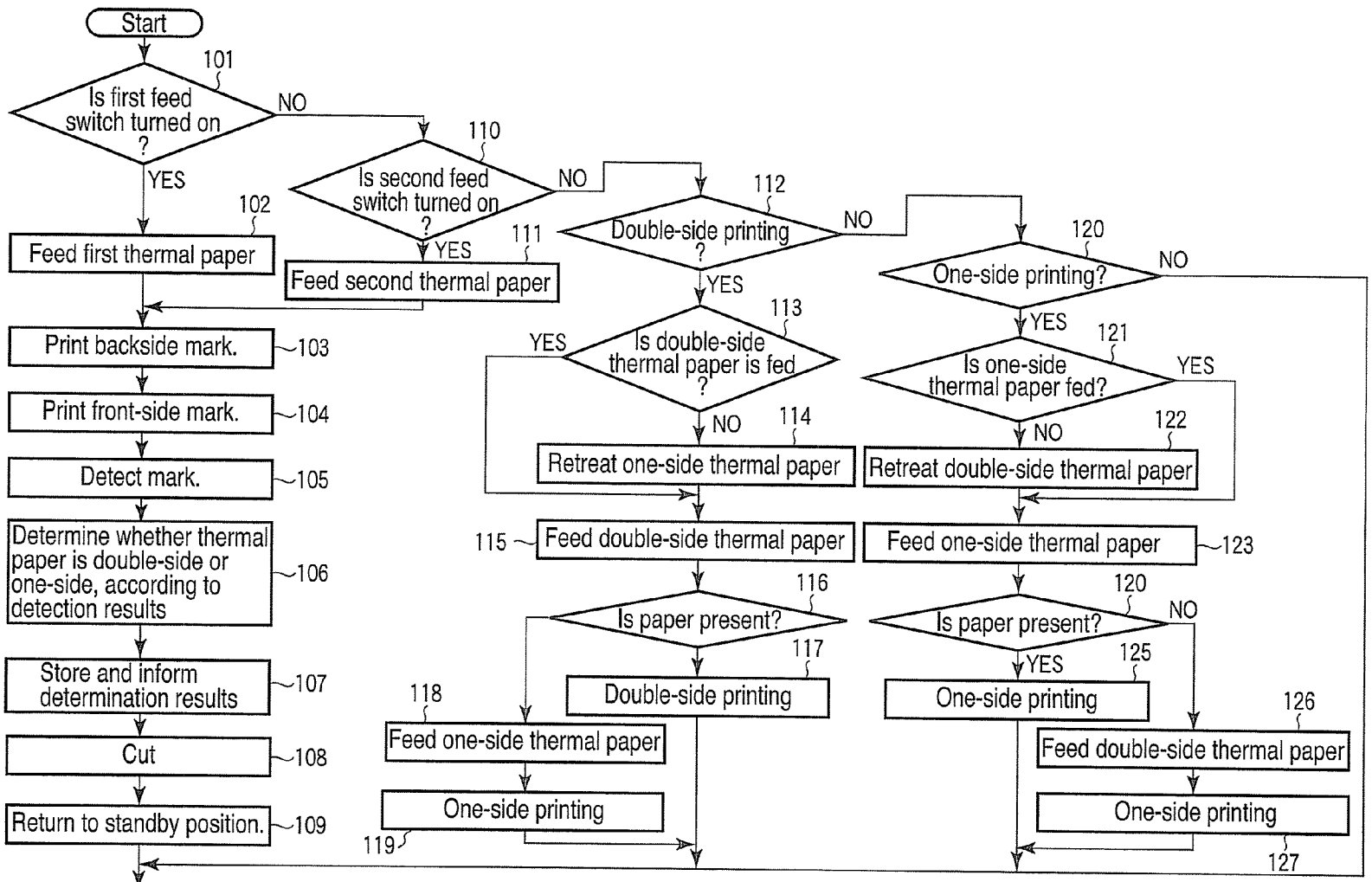
FIG. 4 is a flowchart for explaining operations of an embodiment of the invention.

Next, the functions of the embodiment will be explained with reference to the flowchart of FIG. 4.

[1] Setting Thermal Paper A and B

The user sets two kinds of thermal paper A and B in the paper housing unit 1, and pulls out the front end of the thermal paper A, runs it over the roller 2, and inserts it into the inlet slit 3*a* of the feeder 3. The front end of the inserted thermal paper A is held and fed by paper-feeding rollers 4*a* and 4*b* in the feeder 3, detected by a paper sensor 5, and set ready for printing at a position corresponding to the paper sensor 5. Then, the user pulls out the front end of the thermal paper B set in the paper housing unit 1, runs it over the roller 6, and inserts it into the inlet slit 7*a* of the feeder 7. The front end of the inserted thermal paper B is held and fed by paper-feeding rollers 8*a* and 8*b*, detected by a paper sensor 9, and set ready for printing at a position corresponding to the paper sensor 9.

Figure 5:
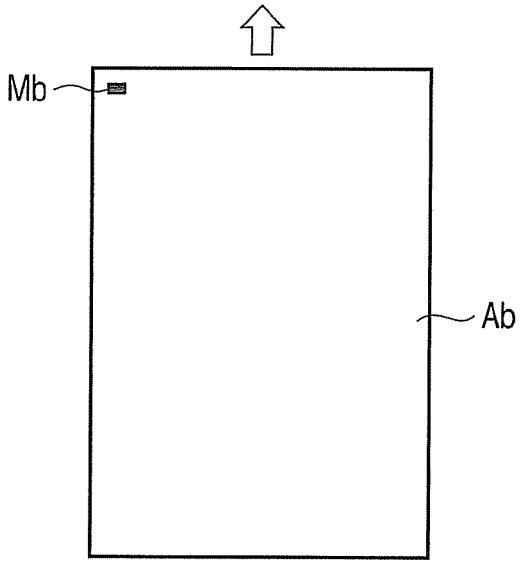
FIG. 5 is a diagram showing a state, in which a backside mark is printed on the back side of thermal paper by double-side printing in an embodiment of the invention.
Figure 6:
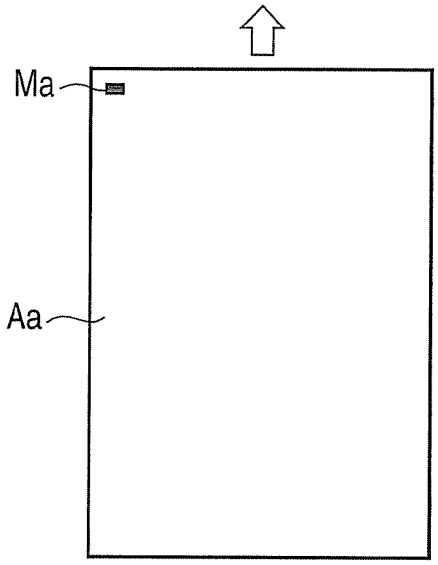
FIG. 6 is a diagram showing a state, in which a front-side mark is printed on the front side of thermal paper by double-side printing in an embodiment of the invention.

Then, the user turns on the first feed switch 35*a* of the operation unit 35 (YES in step 101). As indicated by a solid arrow in FIG. 1, the thermal paper A is delivered and fed from the feeder 3 (step 102). When the front end of the thermal paper A reaches the second thermal head 12, the second thermal head 12 prints a square black backside mark Mb at the front left side position on the back side Ab of the thermal paper A, as shown in FIG. 5 (step 103). Then, when the front end of the thermal paper A reaches the first thermal head 11, the first thermal head 11 prints a square black front-side mark Ma at the front left side position on the front side Aa of the thermal paper A, as shown in FIG. 6 (step 104). The black front-side mark may be provided at the center of the paper, in addition to the front left side position.

When the front end of the thermal paper A reaches the second mark sensors 15 and 16, the first and second mark sensors 15 and 16 detect the front-side mark Ma and backside mark Mb printed on the front side Aa and back side Ab of the thermal paper A (step 105). According to the detection results, whether the fed thermal paper A is double-side thermal paper or one-side thermal paper is determined (step 106). In other words, both front-side mark Ma and backside mark Mb are detected, and the thermal paper A is determined to be double-side thermal paper. The determination result is stored in the RAM 23, and informed the user by the character display on the display unit 36 (step 107). By watching the display, the user can exactly check whether the thermal paper A set by the user is suitable thermal paper. If the thermal paper A is not suitable thermal paper, the user can quickly change the thermal paper A to another suitable thermal paper.

When the mark printed area of the front end of the thermal paper A passes through the cutter 17 beyond the first and second mark sensors 15 and 16, the thermal paper A is stopped and cut with the cutter 17 (step 108). After the thermal paper A is cut, the thermal paper A is fed back to the feeder 3 and returned to the paper housing unit 1 as indicated by a dashed arrow in FIG. 7. When the front end (the cut end) of the thermal paper A is detected by the paper sensor 5 in the feeder 3, the feeding-in of the thermal paper A is stopped, and the front end of the thermal paper A is set ready for printing at a position corresponding to the paper sensor 5 as shown in FIG. 7.

Figure 7:
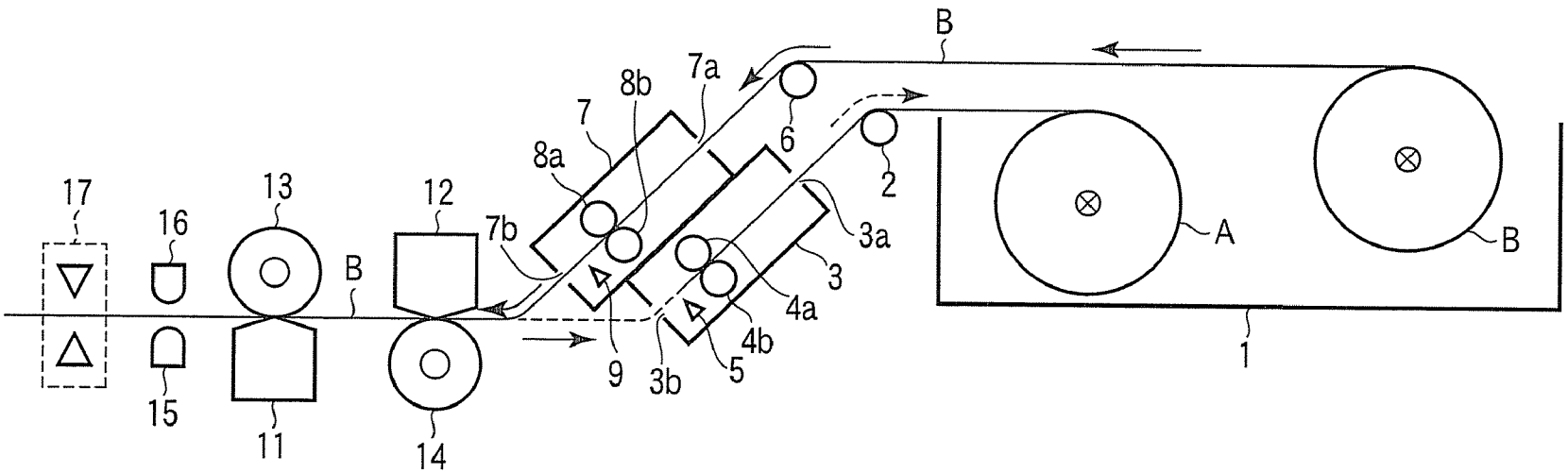
FIG. 7 is a diagram showing a state, in which thermal paper is fed from the other feeder in an embodiment of the invention.

When the user turns on the second feed switch 35*b* of the operation unit 35 (NO in step 101, YES in step 110), the thermal paper B is delivered and fed from the feeder 7 as indicated by a solid arrow in FIG. 7 (step 111). When the front end of the fed thermal paper B reaches the second thermal head 12, the second thermal head 12 prints the square black backside mark Mb at the front left side position on the back side Bb of the thermal paper B (step 103). Then, when the front end of the thermal paper B reaches the first thermal head 11, the first thermal head 11 prints the square black front-side mark Ma at the front left side position on the front side Ba of the thermal paper B (step 104).

When the front end of the thermal paper B reaches the second mark sensors 15 and 16, the first and second mark sensors 15 and 16 detect the front-side mark Ma and backside mark Mb printed on the front side Ba and back side Bb of the thermal paper B (step 105). According to the detection results, whether the fed thermal paper B is double-side thermal paper or one-side thermal paper is determined (step 106). In other words, only the front-side mark Ma is detected, and the thermal paper B is determined to be one-side thermal paper. The determination result is stored in the RAM 23, and informed the user by the character display on the display unit 36 (step 107). By watching the display, the user can exactly check whether the thermal paper B set by the user is suitable thermal paper. If the thermal paper B is not suitable thermal paper, the user can quickly change the thermal paper B to another suitable thermal paper.

When the mark printed area of the front end of the thermal paper B passes through the cutter 17 beyond the first and second mark sensors 15 and 16, the thermal paper B is stopped and cut with the cutter 17 (step 108). After the thermal paper B is cut, the thermal paper B is fed back to the feeder 7 and returned to the paper housing unit 1 as indicated by a dashed arrow in FIG. 1. When the front end (the cut end) of the thermal paper B is detected by the paper sensor 9 in the feeder 7, the feeding-in of the thermal paper B is stopped, and the front end of the thermal paper B is set ready for printing at a position corresponding to the paper sensor 9 as shown in FIG. 1.

[2] Double-Side Printing

When a double-side print job is input (NO in step 101, NO in step 110, YES in step 112), whether the thermal paper (double-side thermal paper) A suitable for the double-side print job has been fed to the feeder 3 is checked (step 113). If the thermal paper (one-side thermal paper) B has been fed (NO in step 113), the thermal paper (one-side thermal paper) B is retreated to a retreat position (step 114). After the thermal paper B is retreated, or if it is determined that the thermal paper (double-side thermal paper) A has been fed according to the above check result (YES in step 113), the thermal paper (double-side thermal paper) A on standby in the feeder 3 is fed to the first and second thermal heads 11 and 12 as indicated by a solid arrow in FIG. 1 (step 115). At this time, when the thermal paper A has been actually fed to the feeder 3 and detected by the paper sensor 5, it is assumed that thermal paper is present (YES in step 116), and double-side printing is executed for the fed thermal paper A (step 117).

Figure 8:
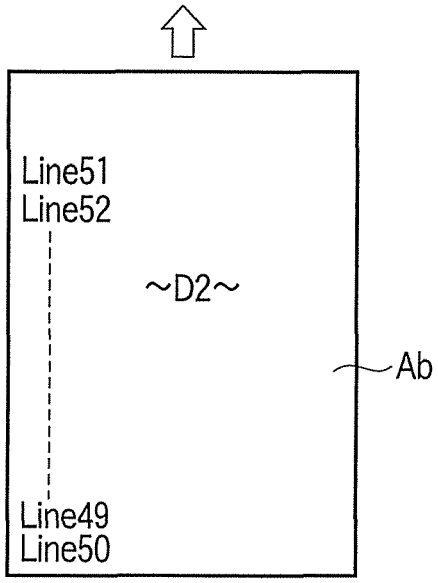
FIG. 8 is a diagram showing a state, in which print data D2 is printed on the back side of thermal paper by double-side printing in an embodiment of the invention.
Figure 9:
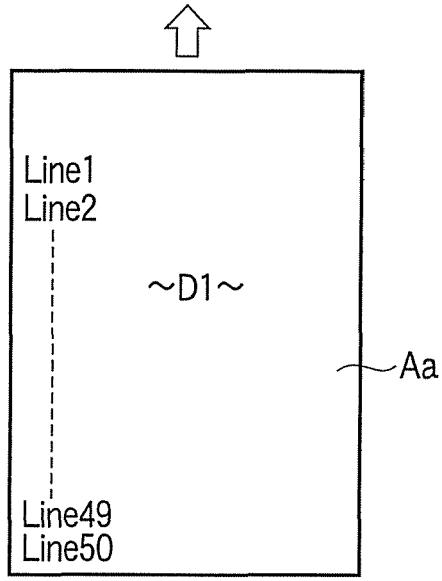
FIG. 9 is a diagram showing a state, in which print data D1 is printed on the front side of thermal paper by double-side printing in an embodiment of the invention.

In other words, in double-side printing, the print data D0 supplied from the host unit 50 is divided into print data D1 and print data D2, and stored in the RAM 23. As the thermal paper A is fed, the print data D2 is first printed on the back side Ab of the thermal paper A with the second thermal head 12 as shown in FIG. 8, and then the print data D1 is printed on the front side Aa of the thermal paper A with the first thermal head 11 as shown in FIG. 9.

When the print area of the printed double-side thermal paper A passes through the cutter 17, the thermal paper A is stopped there, and cut by the cutter 17. After the thermal paper A is cut, the thermal paper A is fed back to the feeder 3 and returned to the paper housing unit 1 as indicated by a dashed arrow in FIG. 7, and the front end (the cut end) of the thermal paper A is set ready for printing at a position corresponding to the paper sensor 5 in the feeder 3.

If the thermal paper A is not present in the feeder 3 when starting double-side printing, or the thermal paper A runs out during double-side printing, the paper sensor 5 detects it and determines that paper is not present (NO in step 116). In this case, as a backup measure, the thermal paper (one-side thermal paper) B set on standby in the other feeder 7 is fed to the first and second thermal heads 11 and 12 as indicated by a solid arrow in FIG. 7 (step 118). Then, one-side printing is executed for the fed thermal paper B with the first thermal head 11 (step 119).

Figure 10:
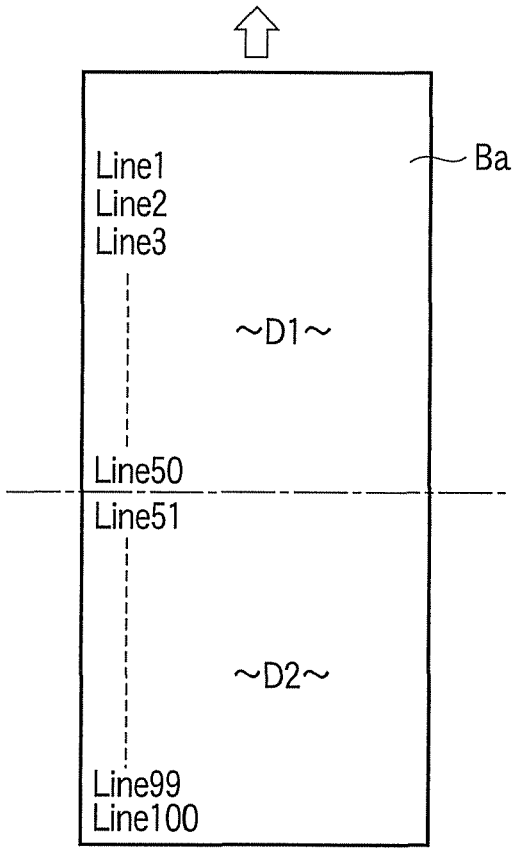
FIG. 10 is a diagram showing a state, in which print data D1 and D2 are printed on the front side of thermal paper by one-side printing in an embodiment of the invention.

In this one-side printing, as shown in FIG. 10, the print data D1 is printed on the front side Ba of the thermal paper B with the first thermal head 11, and the print data D2 is printed on the same front side Ba with the second thermal head 12.

[3] One-Side Printing

When a one-side print job is input (NO in step 101, NO in step 110, NO in step 112, YES in step 118), whether the thermal paper (one-side thermal paper) B suitable for the one-side print job has been fed to the feeder 7 is checked (step 121). If the thermal paper (double-side thermal paper) A has been fed (NO in step 121), the thermal paper (double-side thermal paper) A is retreated to a retreat position (step 122). After the thermal paper A is retreated, or if it is determined that the thermal paper (one-side thermal paper) B has been fed according to the above check result (YES in step 121), the thermal paper (one-side thermal paper) B on standby in the feeder 7 is fed to the first and second thermal heads 11 and 12 as indicated by a solid arrow in FIG. 7 (step 123). At this time, when the thermal paper B has been actually fed to the feeder 7 and detected by the paper sensor 9, it is assumed that thermal paper is present (YES in step 124), and one-side printing is executed for the fed thermal paper B (step 125).

In other words, in one-side printing, as the thermal paper B is fed, the print data D1 is printed on the front side Ba of the thermal paper B with the first thermal head 11, and then the print data D2 is printed on the same front side Ba of the thermal paper B with the second thermal head 12, as shown in FIG. 10.

If the thermal paper B is not present in the feeder 7 when starting one-side printing, or the thermal paper B runs out during one-side printing, the paper sensor 9 detects it and determines that paper is not present (NO in step 124). In this case, the thermal paper (double-side thermal paper) A set on standby in the other feeder 3 is fed to the first and second thermal heads 11 and 12 as indicated by a solid arrow in FIG. 1 (step 126). Then, the print data D1 and D2 are sequentially printed on the front side Aa of the fed thermal paper A with the first thermal head 11, as shown in FIG. 10 (step 127).

[4] Switching of Double-Side Printing and One-Side Printing

In a situation in which the thermal printer 20 is installed in a cash register in a store, and issues a sales receipt, when the number of merchandise purchased by a customer is more than 100 items, for example, it is determined that a long receipt is difficult to handle and double-side printing is executed, and the length of the receipt is reduced. If the number of merchandise purchased by a customer is less than 100 items, one-side printing is executed so that the purchased items can be confirmed at a glance.

[5] Conclusion

As described above, two or more thermal paper A and B can be set in the paper housing unit 1. Whether the thermal paper A and B are double-side thermal paper or one-side thermal paper is previously determined by printing marks and detecting the marks. Based on the determination results, the thermal paper A and B are selectively fed for double-side printing and one-side printing. Double-side thermal paper can be used for double-side printing, and one-side thermal paper can be used for one-side printing. Therefore, thermal paper can be effectively and economically used.

Further, if one thermal paper runs out, the other thermal paper is fed, and printing is continued, and data can be printed to the end. This improves reliability as a thermal printer.

In the embodiment described herein, the front-side mark Ma and backside mark Mb are printed at the left side position in the front end of the thermal paper A and B. The printing position is not limited to this. The printing position may be appropriately set by considering the positions and relationship between the first and second mark sensors 15 and 16. Further, a reflection type optical sensor is used as first and second mark sensors 15 and 16. The kinds of the sensors are not limited to them. The kinds of the sensors may be appropriately selected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

a paper housing unit which sets two or more kinds of thermal paper;

a paper feeding unit which selectively feeds the thermal paper set in the paper housing unit;

a first thermal head which prints one side of thermal paper fed by the paper feeding unit;

a second thermal head which prints the other side of thermal paper fed by the paper feeding unit;

a first control section which feeds thermal paper from the paper feeding unit, and prints a mark on both sides of the thermal paper with the first and second thermal heads;

mark sensors which detects the marks printed by the first control section;

a determination section which determines whether the thermal paper fed from the paper feeding unit is double-side thermal paper having a thermosensitive layer on both sides, or one-side thermal paper having a thermosensitive layer on only one side, according to the detection results of the mark sensors;

a second control section which selects double-side thermal paper set in the paper housing unit based on the determination result of the determination section, and feeds the paper by the paper feeding unit, at the time of double-side printing; and a third control section which selects one-side thermal paper set in the paper housing unit based on the determination result of the determination section, and feeds the paper by the paper feeding unit, at the time of one-side printing.

2. The printer according to claim 1, wherein the paper feeding unit has two or more feeders, in which the front ends of the thermal paper set in the paper housing unit are set, and the feeders selectively feed the thermal paper.

3. The printer according to claim 1, wherein the mark sensors are first mark sensor to detect a mark printed on one side of the thermal paper, and a second mark sensor to detect a mark printed on the other side of the thermal paper.

4. The printer according to claim 3, wherein the determination section determines the thermal paper fed by the paper feeding unit to be double-side thermal paper having a thermosensitive layer on both sides, when both first and second mark sensors detect marks, and the determination section determines the thermal paper fed by the paper feeding unit to be one-side thermal paper having a thermosensitive layer on only one side, when one of the first and second mark sensors detects a mark.

5. The printer according to claim 1, wherein the first thermal head is positioned in the downstream of the second thermal head in the thermal paper feeding direction.

6. The printer according to claim 1, wherein the paper feeding unit selectively feeds the thermal paper set in the paper housing unit, and determines whether the thermal paper is present, the second control section selects the double-side thermal paper set in the paper housing unit based on the determination result of the determination section, and feeds the paper by the paper feeding unit, at the time of double-side printing, and feeds the other thermal paper by the paper feeding unit, when the paper feeding unit detects that the double-side thermal paper runs out, and the third control section selects the one-side thermal paper set in the paper housing unit based on the determination result of the determination section, and feeds the paper by the paper feeding means, at the time of one-side printing, and feeds the other thermal paper by the paper feeding means, when the paper feeding means detects that the one-side thermal paper runs out.

7. A thermal printer comprising:

paper housing means for setting two or more kinds of thermal paper;

paper feeding means for selectively feeding the thermal paper set in the paper housing means;

a first thermal head for printing one side of thermal paper fed by the paper feeding means;

a second thermal head for printing the other side of thermal paper fed by the paper feeding means;

first control means for feeding thermal paper from the paper feeding means, and printing a mark on both sides of the thermal paper with the first and second thermal heads;

mark sensing means for detecting the marks printed by the first control means;

determination means for determining whether the thermal paper fed from the paper feeding means is double-side thermal paper having a thermosensitive layer on both sides, or one-side thermal paper having a thermosensitive layer on only one side, according to the detection results of the mark sensing means;

second control means for selecting double-side thermal paper set in the paper housing means based on the determination result of the determination means, and feeding the paper by the paper feeding means, at the time of double-side printing; and third control means for selecting one-side thermal paper set in the paper housing means based on the determination result of the determination means, and feeds the paper by the paper feeding means, at the time of one-side printing.

8. The printer according to claim 7, wherein the paper feeding means has two or more feeders, in which the front ends of the thermal paper set in the paper housing means are set, and the feeders selectively feed the thermal paper.

9. The printer according to claim 7, wherein the mark sensing means are first mark sensor to detect a mark printed on one side of the thermal paper, and a second mark sensor to detect a mark printed on the other side of the thermal paper.

10. The printer according to claim 9, wherein the determination means determining the thermal paper fed by the paper feeding means to be double-side thermal paper having a thermosensitive layer on both sides, when both first and second mark sensors detect marks, and the determination means determining the thermal paper fed by the paper feeding means to be one-side thermal paper having a thermosensitive layer on only one side, when one of the first and second mark sensors detects a mark.

11. The printer according to claim 7, wherein the first thermal head is positioned in the downstream of the second thermal head in the thermal paper feeding direction.

12. The printer according to claim 7, wherein the paper feeding means selectively feeding the thermal paper set in the paper housing means, and determining whether the thermal paper is present, the second control means selecting the double-side thermal paper set in the paper housing means based on the determination result of the determination means, and feeding the paper by the paper feeding means, at the time of double-side printing, and feeding the other thermal paper by the paper feeding means, when the paper feeding means detecting that the double-side thermal paper runs out, and the third control means selecting the one-side thermal paper set in the paper housing means based on the determination result of the determination means, and feeding the paper by the paper feeding means, at the time of one-side printing, and feeding the other thermal paper by the paper feeding means, when the paper feeding means detecting that the one-side thermal paper runs out.

13. A method of controlling a thermal printer having a paper housing unit which sets two or more kinds of thermal paper for housing two or more kinds of thermal paper; a paper feeding unit which selectively feeds the thermal paper set in the paper housing unit; a first thermal head which prints one side of thermal paper fed by the paper feeding unit; and a second thermal head which prints the other side of thermal paper fed by the paper feeding unit, the method comprising:

feeding thermal paper from the paper feeding means, and printing a mark on both sides of the thermal paper with the first and second thermal heads, respectively;

detecting the printed marks;

determining whether the thermal paper fed from the paper feeding unit is double-side thermal paper having a thermosensitive layer on both sides, or one-side thermal paper having a thermosensitive layer on only one side, according to the mark detection results;

selecting the double-side thermal paper set in the paper housing unit based on the determination result, and feeding the double-side thermal paper by the paper feeding unit, after retreating unsuitable thermal paper to a retreat position, when unsuitable thermal paper is fed, at the time of double-side printing; and selecting the one-side thermal paper set in the paper housing unit based on the determination result, and feeding the one-side thermal paper by the paper feeding unit, after retreating unsuitable thermal paper to a retreat position, when unsuitable thermal paper is fed, at the time of one-side printing.

* * * * *